US007676989B2

(12) United States Patent
Braid et al.

(10) Patent No.: US 7,676,989 B2
(45) Date of Patent: Mar. 16, 2010

(54) MODULAR SPRING MOUNTING FOR A SASH WINDOW COUNTERBALANCE ARRANGEMENT

(75) Inventors: Harold Keith Braid, Edenham (GB); Simon Christopher Braid, Peterborough (GB); John Michael Payne, Baston (GB)

(73) Assignee: Clearview Industries Limited, Spalding, Lincolnshire (GB)

( * ) Notice: Subject to any disclaimer, the term of this patent is extended or adjusted under 35 U.S.C. 154(b) by 874 days.

(21) Appl. No.: 10/539,269

(22) PCT Filed: Dec. 9, 2003

(86) PCT No.: PCT/GB03/05351

§ 371 (c)(1),
(2), (4) Date: Dec. 19, 2005

(87) PCT Pub. No.: WO2004/057140

PCT Pub. Date: Jul. 8, 2004

(65) Prior Publication Data

US 2006/0096178 A1 May 11, 2006

(30) Foreign Application Priority Data

Dec. 19, 2002 (GB) ..... 0229565.7

(51) Int. Cl.
*E05F 1/00* (2006.01)

(52) U.S. Cl. ..... 49/447; 49/445; 49/506; 16/197; 16/193

(58) Field of Classification Search ..... 49/447, 49/445, 506; 16/193, 194, 197, 400, 401
See application file for complete search history.

(56) References Cited

U.S. PATENT DOCUMENTS

| | | | | |
|---|---|---|---|---|
| 5,353,548 | A * | 10/1994 | Westfall | 49/446 |
| 5,365,638 | A | 11/1994 | Braid et al. | |
| 5,463,793 | A * | 11/1995 | Westfall | 16/197 |
| 6,393,661 | B1 * | 5/2002 | Braid et al. | 16/197 |
| 6,412,144 | B1 * | 7/2002 | Braid et al. | 16/197 |
| 6,553,620 | B2 * | 4/2003 | Guillemet et al. | 16/197 |
| 6,584,644 | B2 * | 7/2003 | Braid et al. | 16/197 |
| 6,606,761 | B2 * | 8/2003 | Braid et al. | 16/197 |
| 6,848,148 | B2 * | 2/2005 | Braid et al. | 16/197 |
| 6,901,702 | B2 * | 6/2005 | Liang et al. | 49/181 |

(Continued)

FOREIGN PATENT DOCUMENTS

GB 2 278 626 12/1994

(Continued)

*Primary Examiner*—Jerry Redman
(74) *Attorney, Agent, or Firm*—Richard M. Goldberg

(57) ABSTRACT

A modular spring support mounting for a sash window spring counterbalance arrangement includes at least a first spring support mounting element and a second spring support mounting element each for supporting a respective coil spring. The first spring support mounting element includes a pair of wedged shaped cross section projections. The second spring support mounting element includes an interengagement fitting which engages the pair of wedged shaped cross section projections to in use securely interconnect the first and second spring support mounting elements together. Also a method of installing such a modular spring mounting includes the step of laterally slidingly engaging the spring mounting elements to securely interlock the elements together.

10 Claims, 7 Drawing Sheets

U.S. PATENT DOCUMENTS

| | | | | |
|---|---|---|---|---|
| 6,990,710 | B2 * | 1/2006 | Kunz et al. | 16/193 |
| 2006/0021283 | A1 * | 2/2006 | Schultz | 49/445 |
| 2007/0056216 | A1 * | 3/2007 | Liang et al. | 49/181 |
| 2007/0101654 | A1 * | 5/2007 | Robertson | 49/445 |
| 2008/0120804 | A1 * | 5/2008 | Annes et al. | 16/198 |

FOREIGN PATENT DOCUMENTS

| | | |
|---|---|---|
| GB | 2 295 634 | 6/1996 |
| GB | 2 369 644 | 6/2002 |
| GB | 2 380 758 | 4/2003 |

* cited by examiner

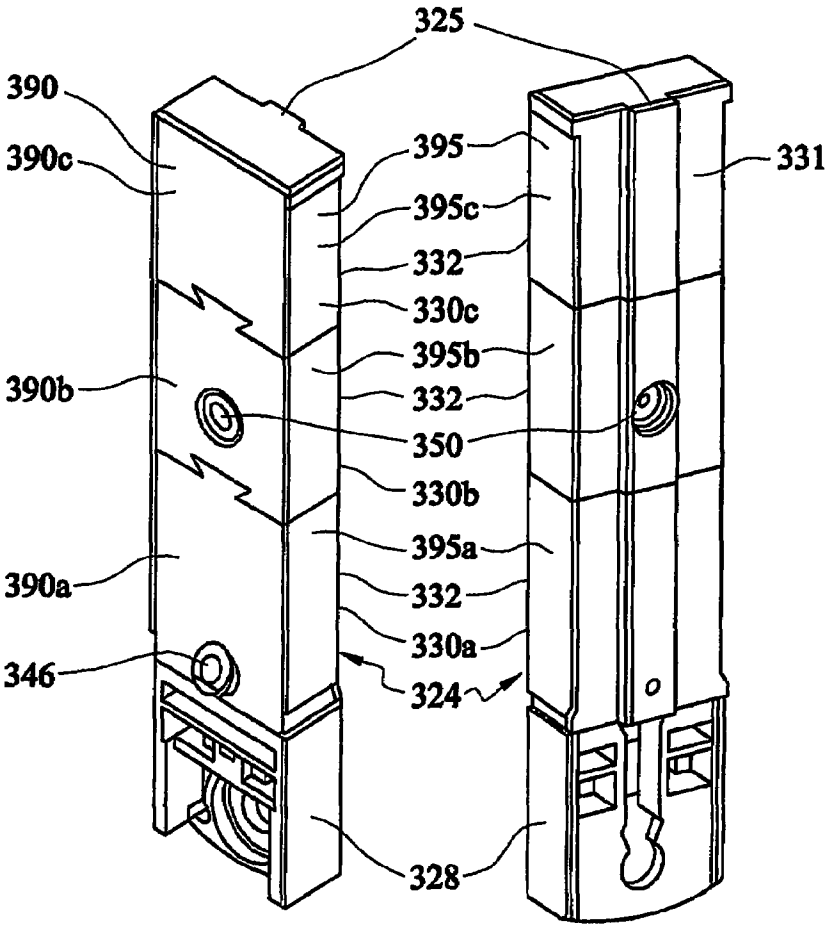
FIG. 10B
FIG. 10A
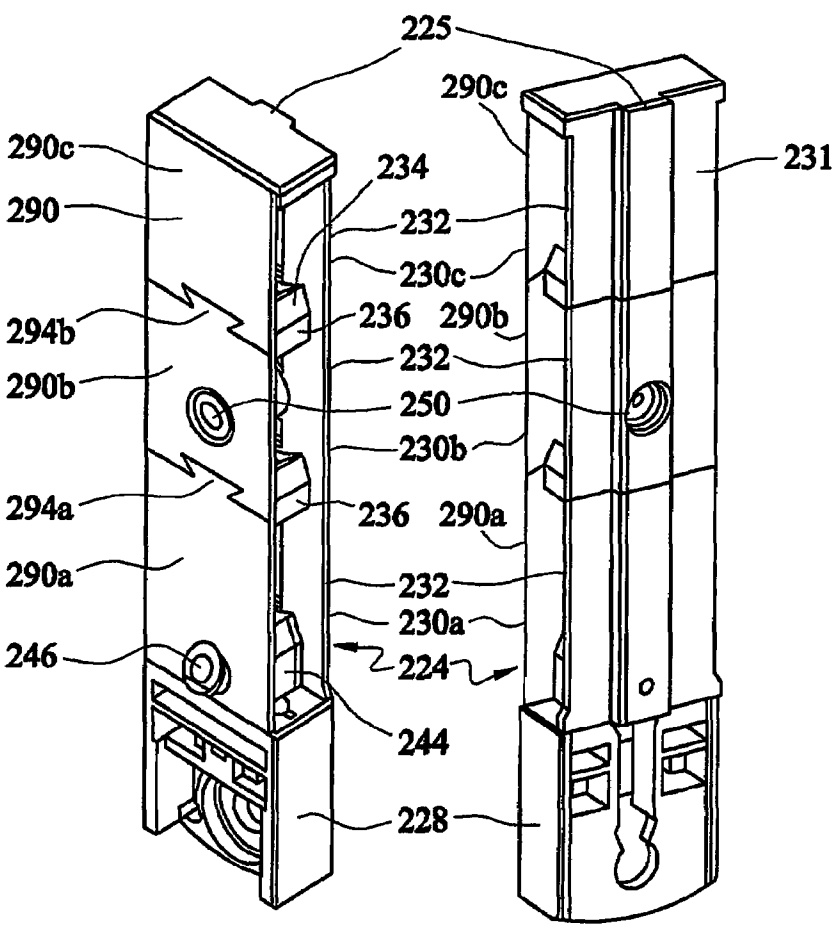
FIG. 9B
FIG. 9A

MODULAR SPRING MOUNTING FOR A SASH WINDOW COUNTERBALANCE ARRANGEMENT

BACKGROUND OF THE INVENTION

The present invention relates to sash windows and in particular to a mounting for a spring counterbalance arrangement used in such sash windows.

Modern sash windows utilise coiled ribbon springs which are mounted within the window jamb channels of the window frame and are arranged to unwind as the sash window is slid and moved within the window frame. The coiled springs provide a counterbalancing force, by virtue of the spring tension of the springs, to counterbalance the weight of the sash window thereby making movement and opening of the window easier. Typically the coiled springs are mounted to the window framed within the vertical window jamb channels either side of the sash window using a mounting/support arrangement. A free end, referred to as a tail, of the spring is connected to a sash shoe slidably located within the window jamb channel. The sash shoe in turn is connected to the sash window, usually towards the lower portion of the sash window. The coiled springs are generally of a constant tension type in which an outer profile of the coil is rotatably held and supported within the spring mounting/support. The spring mounting/support is secured to the window frame within the window jamb channel. An inner end of the spring is free such that the coiled spring can rotate as the spring is unwound and the tail (outer free end) of the spring attached to the sash shoe, is extended and drawn out as the window is moved.

Examples of prior arrangements of the above general type are well-known and common place within the industry. Specific examples are described in the following patents and patent applications:

UK Published Patent application GB 2369644;
UK Published Patent application GB 2380758;
U.S. Pat. No. 6,412,144;
U.S. Pat. No. 6,393,661; and
U.S. Pat. No. 5,365,638.

The text of these patents, and patent applications, are incorporated in their entirety herein by reference.

Modular spring support mountings have been proposed in the prior art, for example in U.S. Pat. No. 5,365,638 in which a plurality of spring support mounting elements, one for each single spring, are stacked on top of one another with each mounting element provided with interengagement formations which when the elements are stacked vertically, and are vertically slid together, interengage and 'snap fit' to connect the elements together to form the multiple spring mounting.

With such a modular spring support arrangement spring supports for different numbers of springs, and so different counterbalance forces, can be readily provided by simply adding additional modules to the stack. A modular arrangement is also easier to install within the window jamb channel, with each of the individual modules being separately inserted into the channel and then slid vertically to interengage and stack together.

While the prior modular spring mounting arrangement, as described in U.S. Pat. No. 5,365,638 provides a practical method of mounting and supporting the counterbalance springs, there are a number of problems with such an arrangement, and the modular spring mounting arrangement can be improved generally. In particular, and inherently in the modular arrangement of U.S. Pat. No. 5,365,638, it has been identified that in use the vertical engagement and securing together of the modules is relatively insecure and the individual modules easily become detached from each other once installed, and in particular during opening and closing of the windows. This can lead to jamming of the window, as such a single fixing for the modular arrangement mentioned in U.S. Pat. No. 5,365,638 is not a practical possibility. The modular arrangement of U.S. Pat. No. 5,365,638 is also relatively long and undesirably occupies a significant length of the jamb channel.

It is therefore desirable to provide an improved modular spring mounting arrangement for a sash window counterbalance which addresses the above described problems and/or which offers improvements generally.

SUMMARY OF THE INVENTION

According to the present invention there is provided a modular spring mounting for a sash window counterbalance arrangement, and a method of installing a modular spring mounting for a sash window counterbalance arrangement, as described in the accompanying claims.

In an aspect of an embodiment of the invention there is provided a modular spring support mounting for a sash window spring counterbalance arrangement. The modular spring support mounting comprises at least a first spring support mounting element and a second spring support mounting element each for supporting a respective coil spring. The first spring support mounting element includes a pair of wedged shaped cross section projections which extend normally from the spring support mounting element and are laterally spaced apart and inwardly oppositely directed. The second spring support mounting element includes an interengagement fitting which engages the pair of wedged shaped cross section projections to in use securely interconnect the first and second spring support mounting elements together.

This arrangement provides a more secure and compact interconnection and interlocking between the spring support modules of a modular spring support, which in use is less likely to be disrupted and disconnected by vertical impact and/or movement. The more secure interconnection allows the practical use of a single fixing screw to secure the modular spring support, and all of the modules within the channel without (or with a considerably reduced) risk of them becoming detached or the undesirable use of additional fixing screws.

The interengagement fitting preferably comprises a dovetail cross section projection which is engaged between the laterally spaced wedged shaped cross section projections.

The interengagement fitting may comprise a narrowed neck portion corresponding to the lateral spacing between the pair of laterally spaced apart projections. The narrowed neck portion is engaged between the pair of laterally spaced apart projections to in use securely interconnect the first and second spring support mounting elements together.

Alternatively the interengagement fitting comprises a pair of corresponding shoulder supports upon within which the respective wedged shaped cross section projections abut and are engaged. Each of the shoulder supports may comprise a cradle corresponding to, and for, a respective wedged shaped cross section projection. Each of the shoulder supports then further comprises a lip edge which hooks over an upper apex edge of the respective wedged shaped cross section projection fitted to vertically secure the wedge shaped cross section projections vertically within the shoulder support.

The interengagement fitting and pair of wedged shaped cross section projections are adapted to engage and securely interconnect the first and second spring support mounting elements together by aligning the interengagement fitting and pair of wedged shaped cross section projections and laterally sliding the spring support mounting elements relative to each other.

The interengagement fitting and pair of wedged shaped cross section projections together preferably further define and provide a support surface for at least one of the coiled ribbon springs.

This provides a simple and compact arrangement which is easy to manufacture with the interengagement fitting and pair of wedged shaped cross section projections advantageously having an interrelated dual functionality.

In a further aspect of an embodiment of the invention there is provided a modular spring support mounting for a sash window spring counterbalance arrangement. The modular spring support mounting comprising at least a first spring support mounting element and a second spring support mounting element. The first spring support mounting element includes a pair of laterally spaced apart projections which extend normally from the spring support mounting element. The second spring support mounting element includes interengagement fitting comprising a narrowed neck portion corresponding to the lateral spacing between the pair of laterally spaced apart projections. The narrowed neck portion is engaged between the pair laterally spaced apart projections to in use securely interconnect the first and second spring support mounting elements together.

In a yet further aspect of an embodiment of the invention there is provided a method of installing a modular spring support mounting for a sash window spring counterbalance arrangement within a window jamb channel section. The modular spring support mounting comprising at least a first spring support mounting element and a second spring support mounting element. The first and second spring support mounting elements including a corresponding wedged shaped interlocking arrangement to securely interlock the spring support mounting elements together. The method comprising:

a) inserting the first spring support mounting element into the window jamb channel, b) laterally aligning the corresponding wedged shaped interlocking arrangement of the first and second spring support mounting elements, and c) laterally sliding the second spring support mounting element relative to the first spring support mounting element to engage the wedged shaped interlocking arrangement and securely interlock the spring support mounting elements together within the window jamb channel.

This method provides a simple and convenient way to install a spring mounting support element for multiple springs (which may overall have a considerable length) within a window jamb channel via a relatively small access opening provided in the window jamb channel. The method also ensures that the mounting elements are securely interlocked together to provide a stable and robust support for the springs.

After inserting the first spring support mounting element into the window jamb channel the first spring support mounting element may be longitudinally slid within the window jamb to align the corresponding wedged shaped interlocking arrangement of the first and second spring support mounting elements.

BRIEF DESCRIPTION OF THE DRAWINGS

The present invention will now be described by way of example only with reference to the following figures in which:

FIGS. 9*a* and 9*b* are perspective views, form the rear and front respectively, of the modular spring mounting arrangement in accordance with a third embodiment of the invention; and FIGS. 10*a* and 10*b* are perspective views, form the rear and front respectively, of the modular spring mounting arrangement in accordance with a fourth embodiment of the invention.

DETAILED DESCRIPTION

Figure 1:
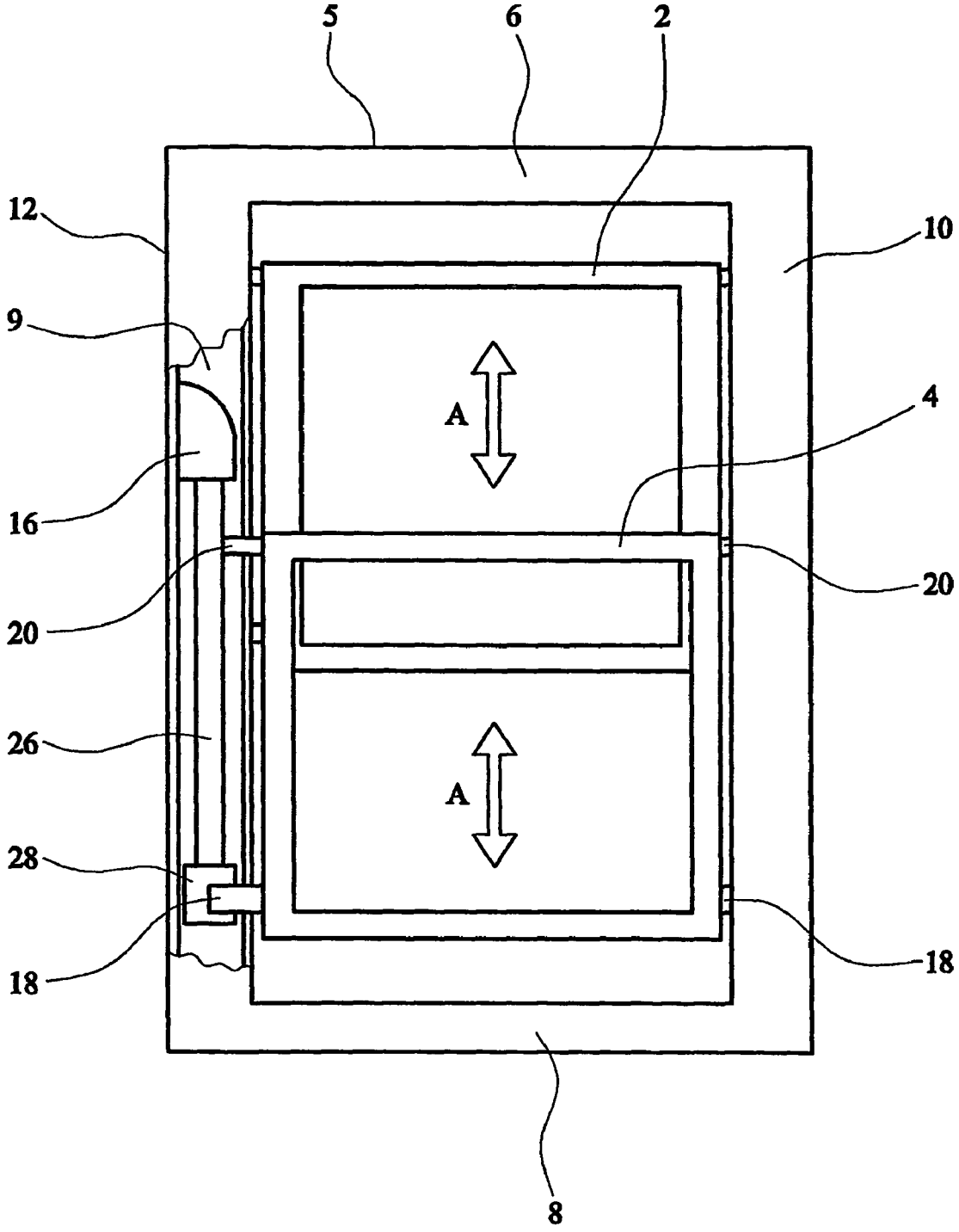
FIG. 1 is a schematic representation of a complete sash window assembly, with part of the window frame cut away to show the spring counterbalance arrangement.
Figure 7:
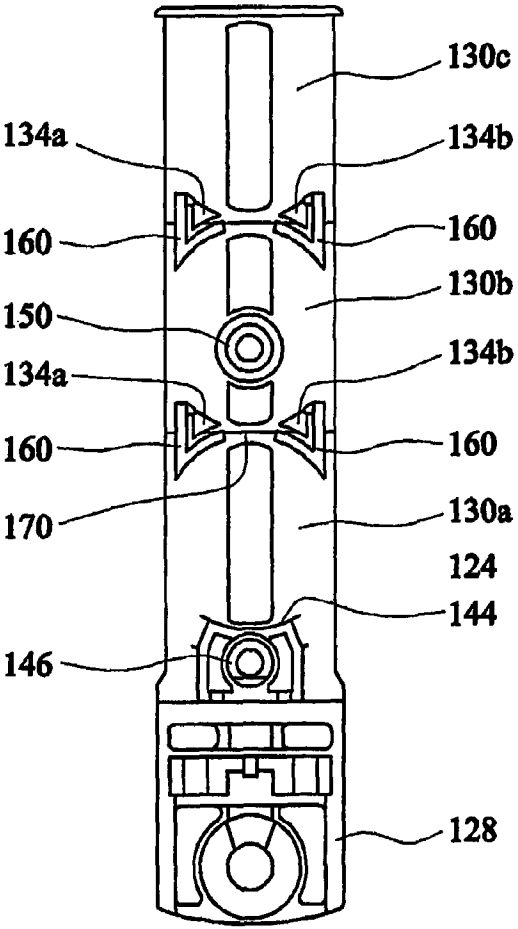
FIG. 7 is an elevational view, similar to that of FIG. 2, of a modular spring mounting in accordance with a second embodiment of the present invention.

Referring to FIG. 1, a sash window 1 comprises upper 2 and lower 4 sashes, which are slidably mounted within a window frame 5 such that each sash 2,4, can be slid vertically, as indicated by arrow A, to open the window. The sashes 2,4, are disposed generally vertically in an overlapping arrangement with one disposed closely adjacent to the other and in operation sliding behind each other.

Figure 4:
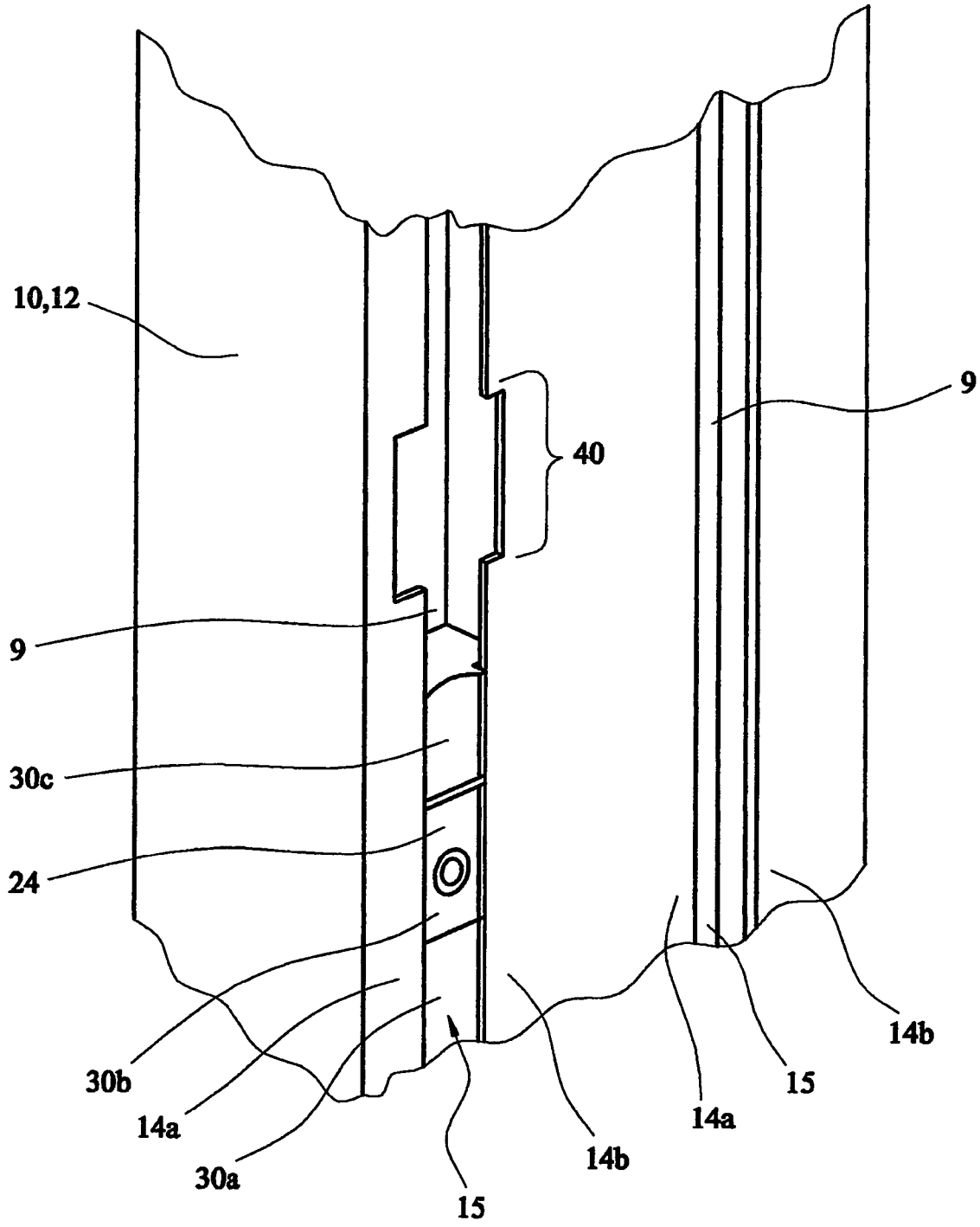
FIG. 4 is a perspective part view of the window jamb showing the window jamb shown in FIG. 1 in more detail with the modular spring mounting for the sash window counterbalance installed within one of the window jamb channels of the window.

The window frame 5 comprises upper 6 and lower 8 horizontal frame members and two vertical laterally spaced window jamb members 10,12. The window jamb members 10,12, each define double vertically extending window jamb channel sections 9, as illustrated in FIG. 4. The window jamb channel sections 9, of the double channel section in each window jamb 10,12, are disposed side by side adjacent to and along the length of the window jamb 10,12, adjacent to the lateral side of a respective sash window 2,4. Each channel section 9 is defined by a rear wall 11, pair of side walls 13 projecting forward from the rear wall 11 and a pair of front walls 14*a*,14*b*, which are parallel and spaced from the rear wall 11 and partially close off the channel section 9. An open part 15 of the channel section 9 faces the respective lateral side of the sash window 2,4. The window frame 5, and window jamb channels 9 are typically fabricated from extruded uPVC sections which are joined together to form the window frame 5. The window frame 5, and window jamb channels 9 may though be fabricated from other materials for example aluminium sections. Each of the channel sections 9 of the double channel sections are generally similar with each channel section 9 of the double channel section within each of the window jambs 10,12, associated with a respective sash window 2,4. At a point along the length of the channel sections 9 there is enlarged access opening 40 where at least a portion of the front walls 14*a*,14*b* are removed/missing to provide a enlarged opening into the channel 9. Such an access opening 40 is an industry standard feature of such window frames, and is typically 50 mm in length. The access opening 40 allows access to the channel 9 for installation and fitting of the counterbalance components within the channel sections 9.

Pivot pins 18, located towards the lower part of the sash window 2,4, extend and project laterally from the lower sides of the sash window 2,4. Tilt latches 20, located towards the upper part of the sash window 2,4, similarly project laterally from the sides of the sash window 2,4. The distal ends of the tilt latches 20 and pivot pins 18 are engaged within the open part 15 of the respective window jamb channels 9. The sash windows 2,4, are thereby slidably located within and with respect to the window frame 5 by the engagement of the pivot pins 18 and tilt latches 20 within the window jamb channels 9. The tilt latches 20 are also laterally retractable with respect to the sash window 2,4, such that the distal ends of the tilt latches 20 can be withdrawn from the window jamb channel sections 9. This allows the upper part of the sash windows 2,4 to be disengaged allowing the sash window 2,4 to be tilted and pivoted about the pivot pins 18.

Spring counterbalance mechanisms 16, to counterbalance the weight of the sash windows 2,4 and make vertical sliding of the sash windows 2,4, easier, are mounted and located within the channel sections 9 of the window jambs 10,12. The window jamb 10,12 and channel 9 are shown in more detail in FIG. 4 in which a spring support mounting can be seen located in the first channel section 9. For each sash window 2,4 a pair of spring counterbalance mechanisms 16 are provided, one on each lateral side of the sash window 2,4, with the mechanisms 16 located and mounted within the respective channel section 9 in the window jamb 10,12 for each sash window 2,4. In FIG. 1 only one such mechanism 16 has been schematically shown for one side of sash window 4, in the interests of clarity and brevity. The other spring counterbalance mechanism 16 on the other lateral side and mounted within the opposite window jamb channel section of the opposite window jamb 10 is generally similar. The other sash window 2 has a similar arrangement albeit mounted within the other channel section 9 of the respective window jambs 10,12 and located at a different position along the window jamb 10,12 as required for operative movement of that sash window 2.

The spring counterbalance mechanism 16 comprises a spring arrangement comprising one or more springs 22, which are located and supported by and within a spring support mounting 24. The spring support mounting 24 is located within the channel section 9 within the window jamb 12 and window jamb channel section 9 and is fixed and secured in position to the window jamb 12. The outer free ends of the springs 22 are connected together to form a common tail 26 which extends, and in operation is drawn out from the spring support mounting 24, and is connected to a sash shoe 28. The sash shoe 28 is slidably located within the window jamb channel section 9. The pivot pin 18 of the sash window 4 is located and engaged within the sash shoe 28.

In operation, as the sash window 4 slides vertically within the window frame 5 the sash shoe 28 which is connected thereto slides vertically within the window jamb channel 9 and draws out the spring tail 26 from the spring support 24. This unwinds the spring (or springs) providing a vertical tension force. This counterbalances and offsets the weight of the sash window 4.

As described above the arrangement is generally conventional.

Figure 3:
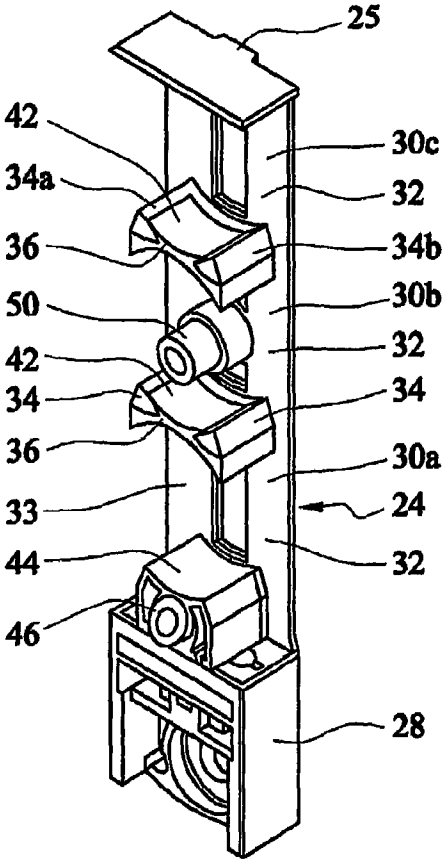
FIG. 3 is a perspective view of the modular spring mounting arrangement shown in FIG. 2, but with the coil springs omitted for clarity.
Figure 2:
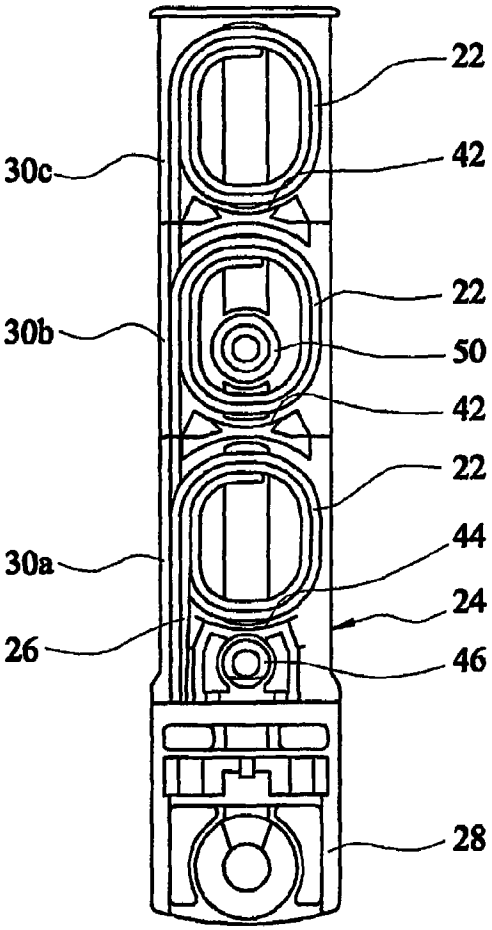
FIG. 2 is a more detailed elevational view of the modular spring mounting arrangement, in accordance with an embodiment of the present invention, for the sash window spring counterbalance arrangement of FIG. 1, and showing the modular spring mounting arrangement, coil springs and sash shoe of the sash window counterbalance arrangement.
Figure 5C:
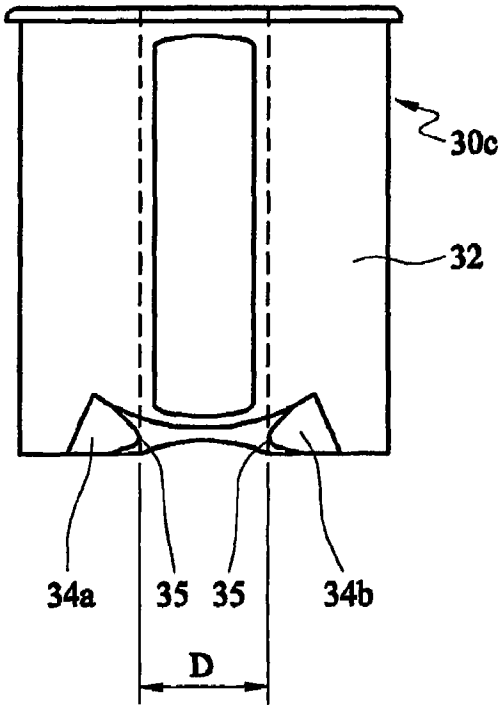
FIGS. 5*a*, 5*b*, and 5*c* are respectively more detailed views of the respective lower, middle and upper spring mounting element modules of the modular spring mounting shown in FIG. 2.
Figure 5B:
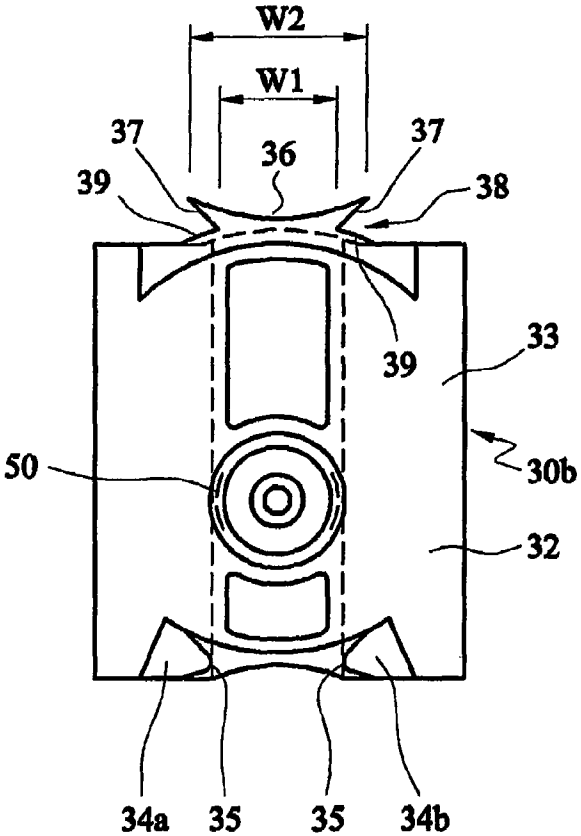
Figure 5A:
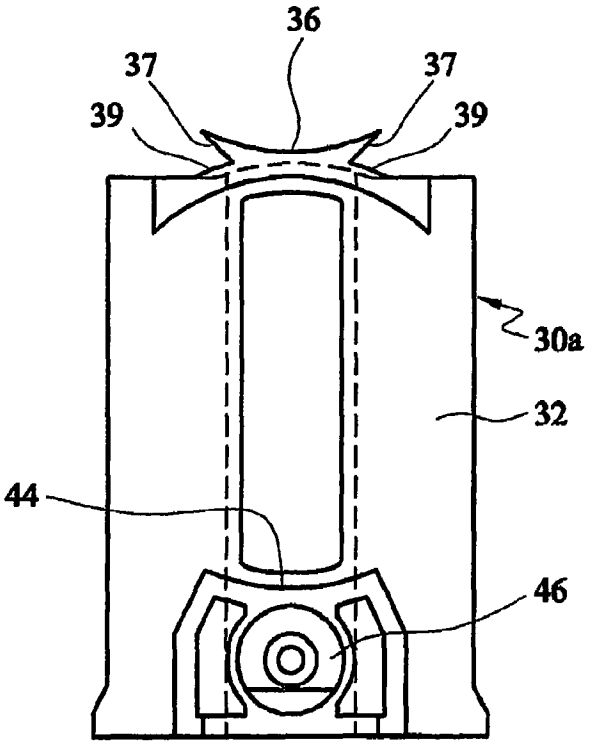

The modular spring support mounting 24 of a first embodiment of the invention is shown in more detail in FIGS. 3 and 4, in which the sash shoe 28 is also shown abutting the bottom of the modular spring support mounting 24. The modular spring support mounting 24 comprises, in this embodiment, three spring support module elements (a lower spring support module element 30*a*, a middle spring support module element 30*b*, and an upper spring support module element 30*c*) for three respective coil ribbon springs 22. The individual spring support mounting elements 30*a*,30*b*,30*c* (or modules) are each shown in more detail in FIGS. 5*a* to 5*c*. Each individual spring 22 is supported by a respective spring support module 30*a*,30*b*,30*c*. As will be explained further, the spring support elements 30*a*,30*b*,30*c* are, when assembled and installed in the window jamb channel 9, interengaged together and stacked vertically on top of one another (as illustrated in FIGS. 2 and 3) to provide the spring support mounting assembly 24 for the springs 22 within the window channel 9.

The spring support mounting elements 30*a*,30*b*,30*c* comprise a generally planar main body portion 32 having a front 31 and rear surface 33. When installed within the channel 9 the main body portion 32 is arranged adjacent the front wall 14*a*,14*b* of the channel 9 with the front surface 31 facing outwards from the channel 9 opening 15. The coil springs 22 in use are disposed and mounted adjacent the rear surface 33 and accordingly the springs 22 are enclosed by the main body portion 32 within the channel 9. Longitudinally along the front surface 31 of the main body there is a spine 25, which strengthens and reinforces the planar main body 32 and when installed is preferably engaged within the opening 15 between the front walls 14*a*,14*b* preventing rotation of the spring support mounting arrangement 24 within the channel 9.

The spring support module elements 30*a*,30*b*,30*c* are in use secured together vertically by an interlocking arrangement which securely interconnects the spring support module elements 30*a*,30*b*,30*c* on top of one another such that they cannot be vertically separated.

Specifically the upper 30*c* and middle 30*b* spring support module elements include respectively a pair 34 of wedged shaped projections 34*a*, 34*b* which project and extend normally from the rear surface 33 of the main body 32 of the spring support module elements 30*a*, 30*b*. The wedge shaped projections 34 are laterally spaced towards respective sides of the spring support module element 30*c*, 30*b* at the bottom of the elements 30*b*, 30*c*. The wedge shaped projections 34 have a generally triangular cross section and are oppositely directed such that they point inwardly towards each other with a lateral spacing D between an apex edge 35 of the respective projections 34. The lower 30*a* and middle 30*b* spring support module elements include, respectively, an interengagement fitting arrangement comprising a dovetail cross section projection 36 at the top and centre of the spring support module elements 30*a*, 30*b*. This dovetail projection 36 includes a narrowed neck portion 38 which has a width W1 corresponding to the lateral spacing D between the wedge shaped projections 34. The dovetail projection 36 further includes outwardly divergent angled side walls 37 which correspond to the faces of the wedge projections 34 with a distal end of the dovetail projection 36 having a width W2 greater than the lateral spacing D between the wedge shaped projections 34. The dovetail projection 36 thereby defines a pair of parallel grooves extending normally to the spring support module 30*a*, 30*b*, 30*c*. The respective pair of wedge shaped projections 34 and dovetail projections 36 are thereby arranged such that by aligning the narrowed neck portion 38 between the wedge shaped projections 34 and laterally sliding the two together (in a direction normal to the spring support elements 30*a*, 30*b*, 30*c* and along the wedge shaped projections) the dovetail projection 36 can be engaged between the wedge shaped projection 34. Specifically the narrowed neck portion 38, and grooves, are engaged between the apex edges 35 of the wedge shaped projection 34 with the outwardly divergent angled side walls 37 of the dovetail projection 36 abutting upper surfaces of the wedge shaped projections 34. The lower angled surfaces of the wedge shaped projections 34 abut and are supported upon lower shoulders 39 of the dovetail projections 36. FIGS. 2 and 3 show the spring support module elements 30*a*, 30*b*, 30*b* respectively engaged with the dovetail projections 36 fitted and securely engaged between the respective wedge shaped projections 34.

The wedge shaped projections 34 and dovetail projections 36 also have a combined dual functionality. In addition to interlocking the spring support modules 30*a*, 30*b*, 30*c* together as described above, the wedge shaped projections 34 and dovetail projections 36 also additionally provide a support means for supporting the respective coiled ribbon springs 22 associated with the upper and middle spring mounting element 30*b*, 30*c*. As shown in FIG. 2, the dovetail projections 36 and wedge shaped projections 34 when fitted together cooperatively define an upper arcuate support surface 42 upon which the outer circumferential surface of the coiled ribbon spring 22 rests and is supported. This can be contrasted with the lower spring 22 which is supported within the lower spring support mounting element 30*a* by a dedicated spring support 44.

The dual functionality and arrangement for supporting the springs 22 provides a simple and compact overall arrangement as opposed to providing separate spring supports and interlocking features. This dual functionality also simplifies manufacture and reduces manufacturing costs.

A mounting peg 46, similar to that described in U.S. Pat. No. 6,393,661, projects from the lower spring support mounting element 30*a*. When the spring support 24 is assembled and installed in the channel 9 this mounting peg 46 engages a predrilled aperture 48 in the rear channel wall 11 to locate the spring support mounting 24 within the channel 9. The middle spring support mounting element 30*b* further optionally includes a cylindrical bose 50 with a bore defined therein to receive a mounting screw or fastener (not shown) which when installed engages into the rear channel wall 11 to further secure the spring support mounting 24 into the channel 9. Since the individual spring support mounting elements 30*a*, 30*b*,30*c* when assembled and installed in the channel 9 are securely interlocked together it will be appreciated that it is not required to individually secure each of the mounting elements 30*a*,30*b*,30*c* into the channel 9, but that the spring support mounting 24 can be installed as a unit. For example the upper spring support mounting element 30*c* is not separately fixed to the channel 9 by a separate fastener or peg, but is secured by means of its interlocking engagement with the other spring support mounting elements 30*b*,30*a*.

Whilst in this embodiment a combined fixing screw and mounting peg 46 are used to secure and locate the spring support mounting 24 in the channel, it will be appreciated that other arrangements can be used. In particular the mounting arrangements described in U.S. Pat. No. 6,393,661, and U.S. Pat. No. 6,412,144 or published UK patent application number 2380758 could be used.

Figures 6A, 6B, 6C:
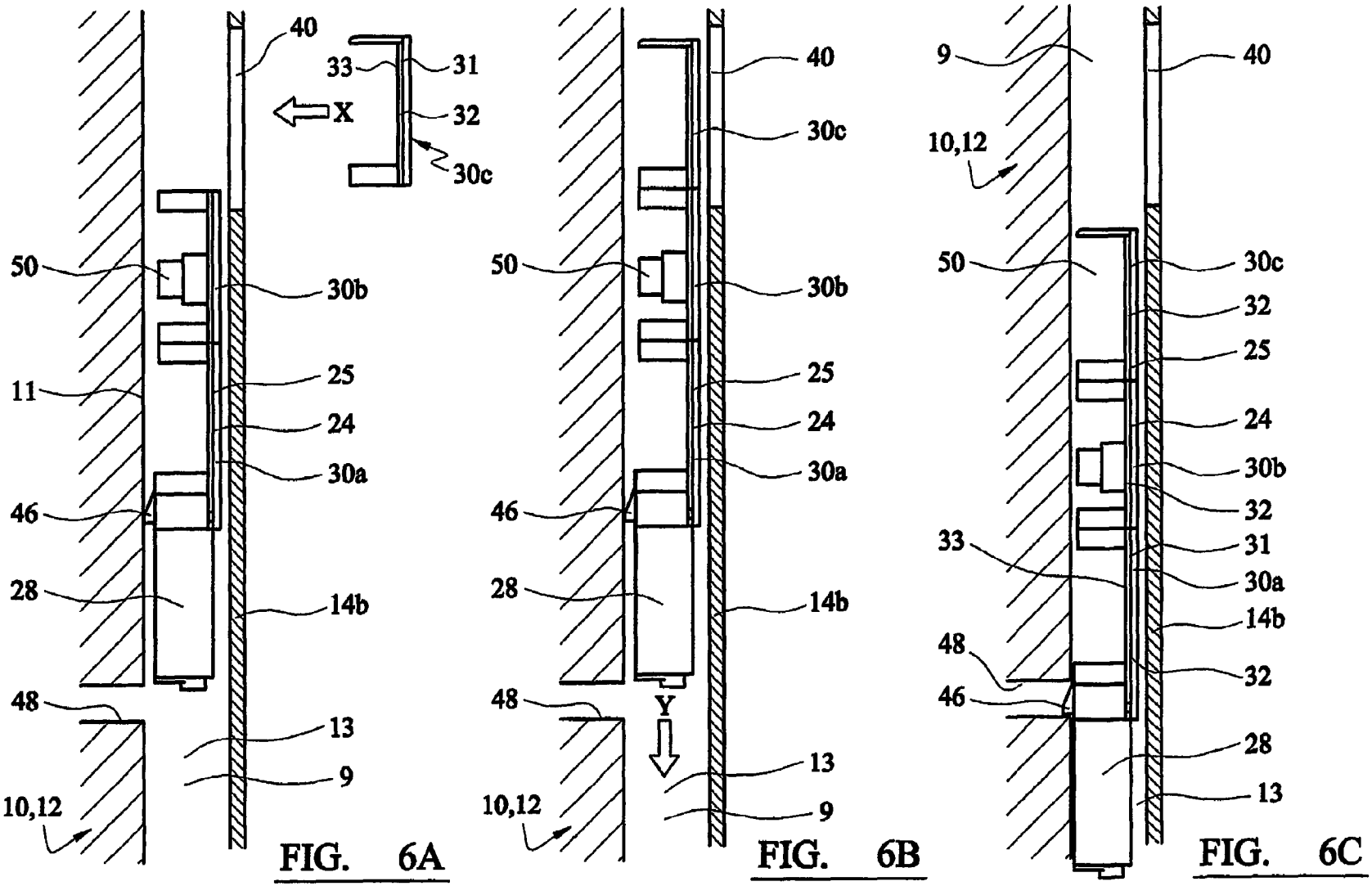
FIGS. 6*a*, 6*b* and 6*c* are a series of schematic illustrative side elevational views illustrating the method of assembling and installing the modular spring mounting shown in FIG. 2 within the window jamb channel.
Figures 8A, 8B, 8C:
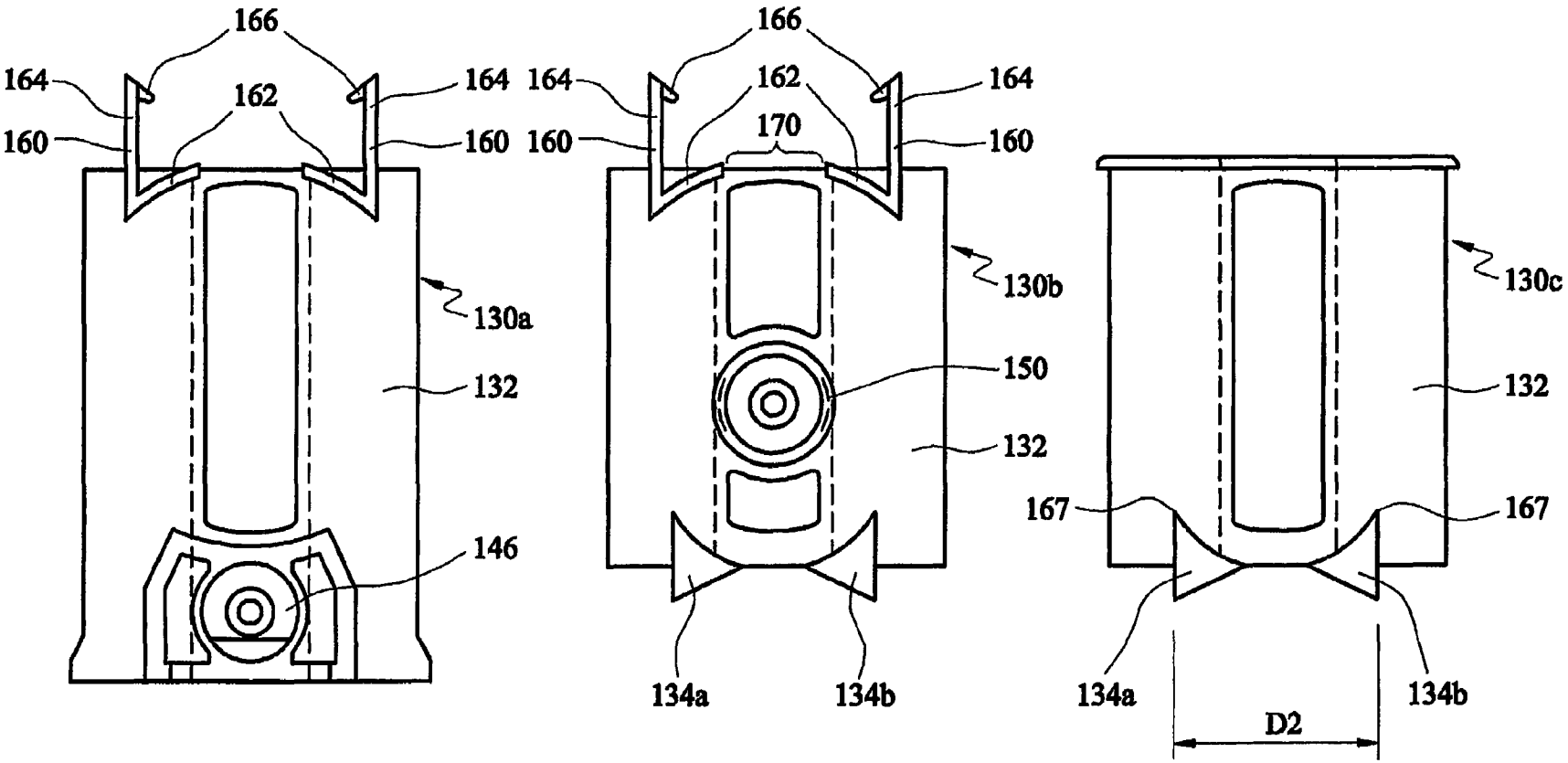
FIGS. 8*a*, 8*b*, and 8*c* are respectively more detailed views of the respective lower, middle and upper spring mounting element modules of the modular spring mounting shown in FIG. 7.

The counterbalance assembly 16 and modular spring support mounting 24 is installed and fitted into the window jamb channel 9 via the access opening 40. First the sash shoe 28 is inserted through the access opening 40 and slid vertically downward in the channel 9 leaving the access opening 40 clear. The lower spring mounting support element 30*a* and associated spring 26 fitted therein is then similarly inserted through the access opening 40 and the lower spring mounting support element 30*a* and shoe 28 are connected and are slid vertically downward in the channel 9 such that the dovetail projection 36 of the lower spring mounting support element 30*a* is visible towards the lower end of the access opening 40. The bottom of the middle spring mounting support element 30*b*, and the wedge shaped projections 34 of the middle spring mounting support element 30*b* are then vertically and laterally aligned with the top of the lower spring mounting support element 30*a*, and the dovetail projection 36 thereof, through the access opening 40 and with the channel 9. The middle spring mounting support element 30*b* is then laterally (in a direction normal to the spring support elements 30*a*, 30*b*, 30*c* and along the wedge shaped projections) slid into the channel section 9, through the access opening 40, and so as to slidingly engage the dovetail projection 36 between the wedge shaped projections 34. The middle spring mounting support element 30*b* is thereby installed within the channel 9 and interlocked on top of, and to, the lower spring mounting support element 30*a*. The upper spring mounting support element 30*c* can then be installed and interlocked in a similar manner, as illustrated in FIGS. 6*a* and 6*b*, with it being aligned with the top of the middle spring mounting support element 30*b* and dovetail projection and laterally slid (as shown by arrow X) into the channel 9 and interlocking engagement with the middle spring mounting support element 30*b* and spring support mounting 24. The entire assembled and interlocking spring support mounting 24 is then slid along the channel 9 until the mounting peg 46 engages the mounting aperture 48 in the rear channel wall 11 as shown in FIG. 6*b*. The fastener (not shown) is then fitted through the boss 50 to secure the spring support mounting 24 in place in the channel 9.

During the above installation process the springs 22 (which are omitted form FIGS. 6*a* to 6*c* for clarity) may be installed with their tails 26 suitably connected to each other and the shoe 28 individually as, and with, each spring mounting support element 30*a*,30*b*,30*c*. Alternatively the springs 22 can all be installed within the channel 9, individually or together without the support elements 30*a*,30*b*,30*c* and connected to the shoe 28. The respective springs 22 are then aligned in the access opening 40 as the spring mounting support elements 30*a*,30*b*,30*c* are laterally inserted into the channel 9 through the access opening 40 and to engage the springs 22.

Once the counterbalance assembly 16 and modular spring support mounting 24 is installed and fitted into the window jamb channel 9 the pivot pins 18 of the sash window 2,4, are engaged and connected to the sash shoe 28.

A second embodiment of the modular spring support is shown in FIGS. 7 and 8*a* to 8*c*. This second embodiment is generally similar to the above described first embodiment and like features are identified by like reference numerals but prefixed by a '1'. In the interests of brevity only the significant differences between this embodiment and the first embodiment will be described.

As shown in FIGS. 7 and 8*a* to 8*c* the spring mounting elements 130*a*,130*b*,130*c* are generally similar to those of the previous described embodiment. However in this embodiment the interengagement fitting and interlocking arrangement between the spring support mounting elements 30/130 differs. Specifically the dovetail projections 36 of the lower 30*a* and middle 30*b* spring support mounting elements are replaced by a pair of shoulder supports 160 upon and within which the wedge shaped projections 134 are engaged. The shoulder supports 160 project and extend from the main body 132 of the spring support mounting elements 130*a*,130*b*. The shoulder supports 160 are laterally spaced across the top of the middle and lower spring support mounting elements 130*a*, 130*b*, correspondingly to the wedge shaped projections 134. Each of the shoulder supports 160 comprises an angled lower support surface 162, and a vertical outer side upstand 164. The lower support surface 162 corresponds to a lower face of the wedge shape projection 134 which cooperatively abuts against the lower support surface 162, whilst the outer side upstand 164 is arranged to abut an outer face of the wedge shaped projection 134. The shoulder supports 160 thereby define and provide a V shaped cradle support for the wedge shaped protections 134. Along the upper distal edge of the outer side upstands 164 there is an inwardly directed lip projection 166 which is located so as to hook over an upper apex edge 166 of the wedge shaped projections 134 to vertically secure the wedge shaped projection 134 within the shoulder support 160.

When the spring support elements 130*a*,130*b*,103*c* are fitted together the wedge shaped projections 134 are engaged and held with the shoulder supports 160, between the outer side upstands 164 and upon the lower support surfaces 162 of the respective shoulder supports 160, with the lip flanges 166 overhanging and hooked over the upper apex of the wedge shaped projections 134. The spring support modules 130*a*, 130*b*,103*c* are assembled and fitted into the channel 9 in a similar manner as described above in relation to the previous embodiment. Specifically the spring support mounting elements are 130*a*,130*b*,103*c* are aligned and then laterally slidingly engaged with each other with, in this embodiment, the wedge shaped projections 134 slidingly engaged inside, between, and on the shoulder supports 160 with the upper apex edge of the wedge shaped projections 134 slid underneath the lip projections 166.

Overall, in this alternative embodiment, the wedge shaped projections 134 are engaged outwardly (by the shoulder supports 160), whereas in the first embodiment the wedge shaped projections 34 are engaged inwardly (by the interengagement fitting (dovetail projections 36)).

A particular further advantage of this second embodiment, with the outwardly engaging wedge shaped projections, is that when assembled, an opening 170 between the wedge shaped projections 134 is provided such that the outer circumferential surfaces of the springs 22 mounted upon the projections 134 within the support elements 130*a*, 130*b*, 130*c* can in use contact each other through this gap 170 when they rapidly recoil. Such an arrangement, and specifically arranging for contact between the springs 22 under rapid recoil is described in our pending published UK application GB 2369644, and provides a means to slow the recoil of the springs 22 under rapid movement in order to prevent damage.

Third and fourth embodiments of a modular spring support 224,324 are shown in FIGS. 9*a*,9*b* and 10*a*,10*b*. These third and fourth embodiments are generally similar to the above described first embodiment and like features are identified by like reference numerals but prefixed by a '2' in the case of the third embodiment and '3' in the case of the fourth. In the interests of brevity only the significant differences between these embodiments and the first embodiment will be described. FIGS. 9*a* and 10*a* are similar views to that shown in FIG. 3 in relation to the first embodiment, whilst FIGS. 9*b*, and 10*b*, are views of the opposite, front surface 231,331 of the modular spring support mounting 224,324 which when installed faces outwards from the channel 9 and channel opening 15. In FIGS. 9*a*,9*b*,10*a*,10*c* as in FIG. 3 the springs 22 have been omitted.

As shown in FIGS. 9*a* and 9*b* the spring mounting elements 230*a*, 230*b*, 230*c* of the spring support mounting 224 of the third embodiment additionally each include generally planar rear wall plates 290*a*, 290*b*, 290*c*. The rear wall plates 290*a*, 290*b*, 290*c* clip onto the spring mounting elements 230*a*, 230*b*, 230*c* via suitable clips or other suitable snap fit attachments (not shown). The rear wall plates 290*a*, 290*b*, 290*c* abut and engage against the respective dovetail protections 236, wedge shaped projections 234, and spring support 244. The clips securely attach the rear wall plates 290*a*, 290*b*, 290*c* to the spring mounting elements 230*a*, 230*b*, 230*c*. The clips may in particular for example comprise pins which project form the rear wall plates and are engaged within corresponding sockets defined within the respective dovetail protections 236, wedge shaped projections 234, and spring support 244 of the spring support mounting elements 230*a, b, c*. The rear wall plates 290*a*, 290*b* also include dovetail tabs 294*a*, 294*b* which may project slightly beyond the plane of the rear wall plates 290*a*, 290*b*. The dovetail tabs 294*a*, 294*b* correspond to the dovetail projections 236 of the spring support mounting elements 230*a*, 230*b*, 230*c* such that the dovetail tabs 294*a*, 294*b* similarly engage between the wedge shaped projections 234 of the spring support mounting elements 230*a*, 230*b*, 230*c* to further secure the rear wall plates 290*a*, 290*b*, 290*c* to the spring support mounting elements 230*a*, 230*b*, 230*c*. The dovetail tabs 294*a*, 294*b* are also engaged within dovetail slots of the other rear wall plates 290*b*, 290*c* to secure the rear wall plates 290*a*, 290*b*, 290*c* together. The lower rear wall plate 290*a* includes a corresponding aperture which fits over the mounting peg 246, whilst the middle rear wall plate 290*b* includes a similar aperture corresponding to the boss 250.

The rear wall plates 290*a*, 290*b*, 290*c* when fitted to the spring mounting elements 230*a*, 230*b*, 230*c* are disposed generally parallel to and spaced apart from the main body portions 232 of the spring support mounting 224. The rear wall plates 290*a*, 290*b*, 290*c* together define a rear wall 290 of the spring support mounting 224. When the spring support mounting 224 is installed within the channel 9 the rear wall portions 290*a*, 290*b*, 290*c* are adjacent to, and may abut against, the rear wall 11 of the channel.

The rear wall plates 290*a*,290*b*,290*c* enclose and protect the springs 22 mounted within and between the rear wall plates 290*a*,290*b*,290*c* and main body 232 of the spring mounting elements 230*a*,230*b*,230*c*. Dust and dirt ingress which may clog the springs is also reduced in this embodiments. In addition the rear wall plates 290*a*,290*b*,290*c*, which are of plastic and integral with the remainder of the spring support mounting elements 230*a*,230*b*,203*c* prevent the metal springs 22 from chafing and rubbing against the rear wall 11 of the channel 9. This is particularly advantageous when the spring support mounting 224 is used within an aluminium channel 9 and/or if the channel rear wall 11 is not continuous or includes further apertures or recess within which the springs 22, if not covered by the rear wall plates

290*a*,290*b*,290*c* could become lodged. The rear wall plates 290*a*,290*b*,290*c* furthermore also add additional strength to the spring support mounting elements 230*a*,230*b*,230*c*.

To gain access to the springs 22, and to install the springs 22, the rear wall plates may be simply unclipped and the respective spring support mounting elements 230*a*,230*b*, 230*c* detached from the respective rear wall plates 290*a*,290*b*, 290*c*.

As shown in FIGS. 10*a* and 10*b* the spring mounting elements 330*a*,330*b*,330*c* of the spring support mounting 324 of the fourth embodiment are similar to those of the third embodiment. In this case though the spring mounting elements 330*a*,330*b*,330*c* additionally further include side wall portions 395*a*,395*b*,395*c* integral with and projecting from the main body portions 332 of the spring mounting elements 330*a*,330*b*,330*c*. The side wall portions 395*a*,395*b*,395*c* are disposed on and along either side of the spring mounting elements 330*a*,330*b*,330*c*. The side wall portions 395*a*,395*b*, 395*c* together define sides walls 295 on either side of the spring support mounting 324.

The side wall portions 395*a*,395*b*,395*c* further enclose and protect the springs 22, which are now totally enclosed within the spring mounting elements 330*a*, 330*b*, 330*c*, side wall portions 395*a*,395*b*,395*c* and rear wall plates 390*a*,390*b*, 390*c*. The side wall portions 395*a*,395*b*,395*c* also further strengthen the spring mounting elements 330*a*,330*b*,330*c*.

In a variation of this embodiment the side wall portions 395*a*,395*b*,395*c* may project from and comprise an integral part of the main body portion 332 of the spring support mounting elements 330*a*,330*b*,330*c* instead of being part of the spring mounting elements 330*a*,330*b*,330*c*. The side wall portions 395*a*,395*b*,395*c* may then include further clip projections to engage the respective dovetail protections, wedge shaped projections, and spring support 244 of the spring support mounting elements 330*a,b,c* and assist in attaching and locating the rear wall plates 390*a*,390*b*,390*c* and side wall portions 395*a*,395*b*,395*c* to the spring mounting elements 330*a*,330*b*,330*c*.

The embodiments illustrated and described above provide a spring mounting arrangement 24,124,224,324 for three springs 22. It will be appreciated that by adding additional spring support mounting elements 30, and in particular further middle spring support mounting elements 30*b*, that a spring support mounting 24 for further springs 22 can be provided. This is particularly advantageous since it allows the number of springs, and so overall spring strength to be varied for different particular applications whilst utilising the same common components and mounting elements. Similarly a twin spring mounting arrangement can be provided by simply utilising the upper 30*a* and lower 30*c* spring support mountings. Furthermore in yet further modifications each spring support mounting elements 30 could be adapted to support more than one spring 22.

Many other minor variations and modifications of the above described invention will also be apparent to those skilled in the art without departing from the invention.

The invention claimed is:

1. A modular spring support mounting arrangement for a sash window spring counterbalance arrangement, the modular spring support mounting arrangement being adapted to be fitted within a window jamb channel and to support and secure springs within the window jamb channel; the modular spring support mounting arrangement comprising:

a plurality of coiled ribbon springs, at least a first spring support mounting element and a second spring support mounting element, each for supporting a respective coil spring, the first spring support mounting element including a pair of interengagement projections which extend normally from the spring support mounting element and are laterally spaced apart, and the second spring support mounting element including an interengagement fitting which engages the pair of interengagement projections to in use securely interconnect the first and second spring support mounting elements together; and at least one of:

the interengagement fitting and interengagement projections define and provide a pair of shoulder supports having a surface on which a respective coiled ribbon spring sits in direct contact therewith directly supporting said one of the coiled ribbon springs, and the interengagement fitting and interengagement projections together perform a dual function of connecting together said spring support mounting elements and supporting the respective coiled ribbon spring directly thereon.

2. A modular spring support mounting arrangement as claimed in claim 1 in which the pair of projections comprise a pair of wedge shaped cross section projections which are inwardly oppositely directed.

3. A modular spring support mounting arrangement as claimed in claim 2 in which the interengagement fitting comprises a dovetail cross section projection which is engaged between the laterally spaced wedged shaped cross section projections.

4. A modular spring support mounting arrangement as claimed in claim 2 in which the interengagement fitting comprises a narrowed neck portion corresponding to a lateral spacing between the pair of laterally spaced wedge shaped cross section projections, and the narrowed neck portion is engaged between the pair of laterally spaced wedge shaped cross section projections to in use securely interconnect the first and second spring support mounting elements together.

5. A modular spring support mounting arrangement as claimed in claim 1 in which each of the shoulder supports comprises a cradle corresponding to, and for, a respective wedged shaped cross section interengagement projection, and in which each of the shoulder supports further comprises a lip edge which hooks over an upper apex edge of the respective wedged shaped cross section interengagement projection fitted to vertically secure the wedge shaped cross section projections vertically within the shoulder support.

6. A modular spring support mounting arrangement as claimed in claim 1 in which the interengagement fitting and pair of interengagement projections are adapted to engage and securely interconnect the first and second spring support mounting elements together by aligning the interengagement fitting and pair of interengagement projections and laterally sliding the spring support mounting elements relative to each other.

7. A method of installing a modular spring support mounting arrangement for a sash window spring counterbalance arrangement within a window jamb channel; the modular spring support mounting arrangement comprising at least a first spring support mounting element and a second spring support mounting element, and a plurality of coiled ribbon springs, the first and second spring support mounting elements including a corresponding interlocking arrangement to securely interlock the spring support mounting elements together, the interlocking arrangement comprises an interengagement fitting and corresponding interengagement projection; the method comprising the steps of:

a) inserting the first spring support mounting element into the window jamb channel, b) laterally aligning the corresponding interlocking arrangement of the first and second spring support mounting elements, and then c) laterally sliding the second spring support mounting element relative to the first spring support mounting element to engage the interlocking arrangement and securely interlock the spring support mounting elements together within the window jamb channel, d) defining and providing a pair of shoulder supports having a surface by at least one of the interengagement fitting and interengagement projection, and e) seating one of the coiled ribbon springs in direct contact on the support surface defined by said at least one of the interengagement fitting and interengagement projection directly supporting said one of the coiled ribbon springs on said support surface, and the interengagement fitting and interengagement projections together perform a dual function of connecting together said spring support mounting elements and supporting the respective coiled ribbon spring directly thereon.

8. A method of installing a modular spring support mounting arrangement as claimed in claim 7 further comprising the step of, after inserting the first spring support mounting element into the window jamb channel, longitudinally sliding the first spring support mounting element within the window jamb channel to align the corresponding interlocking arrangement of the first and second spring support mounting elements.

9. A method of installing a modular spring support mounting arrangement as claimed in claim 7 further comprising the step of longitudinally sliding the first and second spring support mounting elements within the window jamb channel to a required mounting position along the length of the window jamb channel.

10. A method of installing a modular spring support mounting arrangement as claimed in claim 7 in which the window jamb channel includes an access opening at a position along the length of the channel and further comprising the step of laterally inserting the first and second spring support mounting elements through the opening into the window jamb channel.

* * * * *